US009162516B2

(12) United States Patent
Kang et al.

(10) Patent No.: US 9,162,516 B2
(45) Date of Patent: Oct. 20, 2015

(54) DISPLAY BOARD ASSEMBLY

(71) Applicant: ACCO Brands Corporation, Lincolnshire, IL (US)

(72) Inventors: Seesong Kang, Northbrook, IL (US); Jonathen Shearer, Skokie, IL (US); Randeep Dhillon, Grayslake, IL (US)

(73) Assignee: ACCO Brands Corporation, Lake Zurich, IL (US)

( * ) Notice: Subject to any disclaimer, the term of this patent is extended or adjusted under 35 U.S.C. 154(b) by 212 days.

(21) Appl. No.: 13/788,964

(22) Filed: Mar. 7, 2013

(65) Prior Publication Data

US 2014/0255902 A1 Sep. 11, 2014

(51) Int. Cl.

| | |
|---|---|
| ***B43L 1/00*** | (2006.01) |
| ***B43L 19/00*** | (2006.01) |
| ***B43L 1/04*** | (2006.01) |
| ***B43K 23/00*** | (2006.01) |
| ***B43L 1/06*** | (2006.01) |

(Continued)

(52) U.S. Cl.

CPC ..... *B43L 1/04* (2013.01); *B43K 23/002* (2013.01); *B43L 1/00* (2013.01); *B43L 1/06* (2013.01); *B43L 19/00* (2013.01); *B43L 19/0006* (2013.01); *B43L 19/0056* (2013.01); *B43L 21/00* (2013.01); *B43L 21/04* (2013.01)

(58) Field of Classification Search

CPC ..... B43L 1/00; F16M 13/00; F16M 13/02; Y10T 403/7176; F16B 2/20; F16B 2/22; F16B 2/245

USPC ..... 434/365, 408, 415, 417; 248/214, 248/228.7, 230.7, 231.81

See application file for complete search history.

(56) References Cited

U.S. PATENT DOCUMENTS

| | | | |
|---|---|---|---|
| 2,167,296 | A | 7/1939 | Farmer |
| 3,163,943 | A | 1/1965 | Bell |
| 5,649,828 | A | 7/1997 | Kawashima |

(Continued)

FOREIGN PATENT DOCUMENTS

| | | | |
|---|---|---|---|
| CN | 203444667 | U | 2/2014 |
| GB | 2306403 | A | 5/1997 |

(Continued)

OTHER PUBLICATIONS

"Floating Glass Shelf," http://web.archive.org/web/20120727030204/http://www.glassshelf.co.uk/floating-glass-solid.shtml, Jul. 27, 2012.*

(Continued)

*Primary Examiner* — Sam Yao
*Assistant Examiner* — Jennifer L Fassett
(74) *Attorney, Agent, or Firm* — Michael Best & Friedrich LLP

(57) ABSTRACT

A display board assembly includes a display board having a planar surface and an edge extending along at least a portion of the planar surface. The display board assembly also includes a mounting member coupled to the display board. The mounting member defines a first gap adjacent the planar surface of the display board and a second gap adjacent the edge of the display board. The display board assembly further includes a display board accessory including a projection. The display board accessory is removably coupled to the mounting member in one of a first position, in which the projection is received in the first gap, and a second position, in which the projection is received in the second gap.

22 Claims, 15 Drawing Sheets

(51) Int. Cl.

| | |
|---|---|
| ***B43L 21/00*** | (2006.01) |
| ***B43L 21/04*** | (2006.01) |

(56) References Cited

U.S. PATENT DOCUMENTS

| | | | | |
|---|---|---|---|---|
| 5,658,635 | A * | 8/1997 | Davis et al. | 428/81 |
| 5,743,414 | A | 4/1998 | Baudino | |
| 5,989,676 | A | 11/1999 | Davis et al. | |
| 6,394,610 | B2 | 5/2002 | Rodriguez, Jr. | |
| D496,068 | S | 9/2004 | Mandel | |
| 6,945,785 | B2 | 9/2005 | Sohl et al. | |
| 6,948,210 | B1 | 9/2005 | Shah | |
| 7,392,911 | B2 * | 7/2008 | Stitchick et al. | 211/90.02 |
| 7,604,481 | B2 | 10/2009 | Owen et al. | |
| D617,834 | S | 6/2010 | Vasconselos | |
| 7,874,842 | B2 | 1/2011 | Beno | |
| D648,793 | S | 11/2011 | Nash | |
| 8,191,197 | B1 | 6/2012 | Hunsucker | |
| 2006/0216686 | A1 * | 9/2006 | McComb et al. | 434/408 |
| 2010/0117495 | A1 * | 5/2010 | Cornell | 312/34.1 |

FOREIGN PATENT DOCUMENTS

| | | | |
|---|---|---|---|
| JP | 5282440 | U | 6/1977 |
| JP | 59146186 | U | 9/1984 |
| JP | S59146186 | U | 9/1984 |
| JP | H0390994 | U | 9/1991 |
| JP | H08300883 | A | 11/1996 |
| JP | 2004237569 | A | 8/2004 |
| JP | 201176307 | A | 4/2011 |

OTHER PUBLICATIONS

"Flipchart Mobilechart Pro," http://web.archive.org/web/20111008164045/http://www.2x3.pl/en/produkty/office/flipcharty/, Oct. 8, 2011.*

Combined Search and Examination Report received from the UK IPO for GB Appl. No. 1404036.4, dated Aug. 6, 2014, 5 pages.

Team 5 Guys Engineering + 1, Final Presentation, ME 4182, Publicly available before Mar. 7, 2013, 16 pages.

Examination Report from the Intellectual Property Office of Great Britain for Application No. GB1404036.4 dated Mar. 30, 2015 (3 pages).

Search Report from the Intellectual Property Office of Great Britain for Application No. GB1404036.4 dated Mar. 31, 2015 (2 pages).

* cited by examiner

DISPLAY BOARD ASSEMBLY

BACKGROUND

The present invention relates to display board assemblies.

Display boards, such as dry-erase boards, are commonly used to display information in classrooms or offices. Various accessories for use with display boards are sometimes mounted to surfaces or edges of the boards. These accessories are typically attached to the display boards using mounts (e.g., via screws, nails, adhesives, etc.) that may cause permanent damage to the boards. In addition, different types of mounts are usually required to connect each different type of accessory to the display boards.

SUMMARY

In one embodiment, the invention provides a display board assembly including a display board having a planar surface and an edge extending along at least a portion of the planar surface. The display board assembly also includes a mounting member coupled to the display board. The mounting member defines a first gap adjacent the planar surface of the display board and a second gap adjacent the edge of the display board. The display board assembly further includes a display board accessory including a projection. The display board accessory is removably coupled to the mounting member in one of a first position, in which the projection is received in the first gap, and a second position, in which the projection is received in the second gap.

In another embodiment, the invention provides a display board assembly including a display board having a planar surface, an edge extending along at least a portion of the planar surface, and a series of discrete slots formed along the edge. The display board assembly also includes a mounting member received in one of the series of discrete slots and a display board accessory coupled to the mounting member to mount the display board accessory on the display board.

In yet another embodiment, the invention provides a display board assembly including a display board having a planar surface, an edge extending along at least a portion of the planar surface, and a series of discrete slots formed along the edge. The display board assembly also includes a mounting member received in one of the series of discrete slots and extending over a portion of the planar surface and a portion of the edge. The mounting member defines a first gap adjacent the planar surface of the display board and a second gap adjacent the edge of the display board. The display board assembly further includes a first display board accessory including a projection. The first display board accessory is removably couplable to the mounting member in one of a first position, in which the projection is received in the first gap, and a second position, in which the projection is received in the second gap. The display board assembly also includes a second display board accessory that is different from the first display board accessory. The second display board accessory includes a projection. The second display board accessory is removably couplable to the mounting member in one of a first position, in which the projection is received in the first gap, and a second position, in which the projection is received in the second gap, when the first display board accessory is not coupled to the mounting member.

In still another embodiment, the invention provides a display board assembly including a display board having a planar surface, an easel arm movably mounted to the display board, and an easel pad supported by the easel arm. The easel arm is movable between a first position, in which the easel pad covers at least a portion of the planar surface of the display board, and a second position, in which the easel pad is positioned to a side of the planar surface of the display board.

In yet still another embodiment, the invention provides a display board assembly including a display board having a planar surface and an edge extending along at least a portion of the planar surface, a mounting member coupled to the edge of the display board, and an easel arm configured to support an easel pad. The easel arm is coupled to the mounting member. The easel arm is pivotable relative to the display board when connected to the mounting member.

In a further embodiment, the invention provides a display board assembly including a display board having a planar surface and a lower edge extending along a portion of the planar surface. The display board assembly also includes a tray mounted to the lower edge of the display board. The tray defines a recess having a length measured generally parallel to the lower edge and a width measured generally perpendicular to the lower edge. The display board assembly further includes a display board accessory positionable on the tray. The display board accessory includes a main body and a flange extending from the main body. The flange has a width that is generally equal to the width of the recess to inhibit movement of the display board accessory within the recess in a direction generally parallel to the width.

Other aspects of the invention will become apparent by consideration of the detailed description and accompanying drawings.

DETAILED DESCRIPTION

Figure 1:
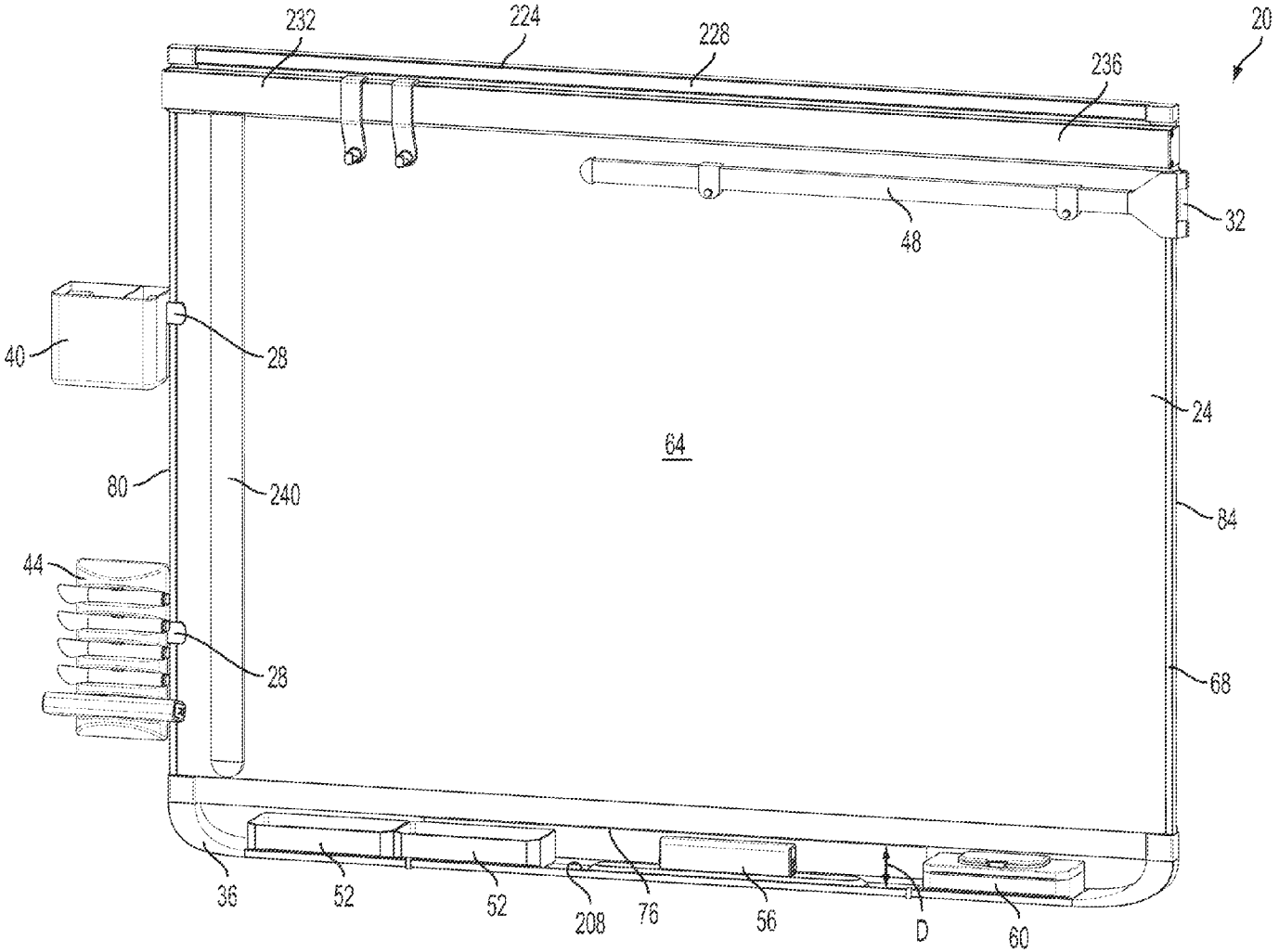
FIG. 1 is a front perspective view of a display board assembly embodying the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. In addition, the terms "upper," "lower," "front," "rear," etc. are used to facilitate description with respect to the orientations shown in the drawings and are not intended to be limiting.

FIG. 1 illustrates a display board assembly 20 embodying the invention. The assembly 20 includes a display board 24, a plurality of mounting members 28, 32 coupled to the display board 24 at various locations, a tray 36 coupled to the display board 24, and a plurality of different display board accessories 40, 44, 48, 52, 56, 60 supported on the display board 24 by the mounting members 28, 32 and the tray 36.

The illustrated display board 24 is a dry-erase board, or whiteboard, and includes a planar surface 64 and a frame 68. In other embodiments, the display board 24 may be a chalkboard, a bulletin board, a corkboard, etc., or a combination of two or more board types. The planar surface 64 is continuous and smooth and is configured to be written on. In embodiments where the display board 24 is a bulletin board or corkboard, the planar surface 64 may be configured to support, for example, thumbtacks or pushpins.

The frame 68 surrounds the planar surface 64 and forms edges 72, 76, 80, 84 of the display board 24. In the illustrated embodiment, the display board 24 is generally rectangular such that the frame 68 forms an upper edge 72 (FIGS. 6A-6F), a lower edge 76, and two side edges 80, 84 around the planar surface 64. In other embodiments, the display board 24 may alternatively be circular, oval-shaped, square, hexagonal, irregular, or the like. The upper edge 72 and the lower edge 76 extend generally parallel to each other. The two side edges 80, 84 also extend generally parallel to each other and are perpendicular to the upper and lower edges 72, 76. The first side edge 80 extends along a first side of the planar surface 64 between the upper and lower edges 72, 76. The second side edge 84 is spaced apart from the first side edge 80 and extends along a second side of the planar surface 64 between the upper and lower edges 72, 76. In some embodiments, the frame 68 may be omitted such that the edges 72, 76, 80, 84 of the display board 24 are defined by or directly formed on the planar surface 64. In the illustrated embodiment, side edges 80, 84 of the frame 68 are formed of molded ABS, and the upper and lower edges 72, 76 are formed of extruded aluminum. In other embodiments, other materials can be used to form the frame 68.

Figure 2:
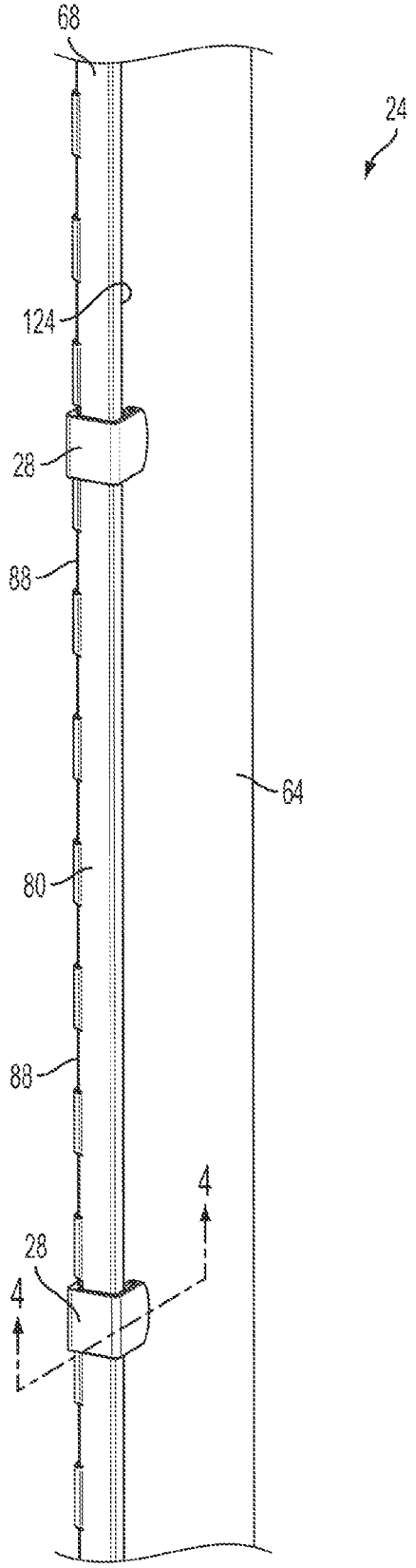
FIG. 2 is an enlarged side perspective view of a portion of the display board assembly.

As shown in FIG. 2, the display board 24 includes a series of discrete slots 88 formed along the first side edge 80. The display board 24 generally includes between ten and twenty-five slots 88 that are evenly spaced along the first edge 80. In other embodiments, the display board 24 may include fewer or more slots 88, depending on the size of the board 24. Furthermore, the slots 88 may alternatively be irregularly spaced along the first edge 80 for different applications. The illustrated slots 88 are defined by the frame 68 and extend into a rear surface of the display board 24 that is opposite the planar surface 64. Each slot 88 is configured (i.e., shaped and sized) to receive a portion of one of the mounting members 28, 32 (FIG. 1) to connect the mounting members 28, 32 to the first edge 80 of the board 24. The spaced-apart arrangement of the slots 88 allows the mounting members 28, 32 to be positioned in different locations along the first edge 80, as desired by a user.

Although not shown in detail, the display board 24 also includes a series of discrete slots formed along the second side edge 84. The slots in the second edge 84 are configured and arranged in the same manner as the slots 88 in the first edge 80, but may alternatively be configured and arranged in a different manner. Similar to the slots 88 in the first edge 80, the slots in the second edge 84 are configured to receive portions of the mounting members 28, 32 to connect the mounting members 28, 32 to the second edge 84 of the board 24.

Figure 3A:
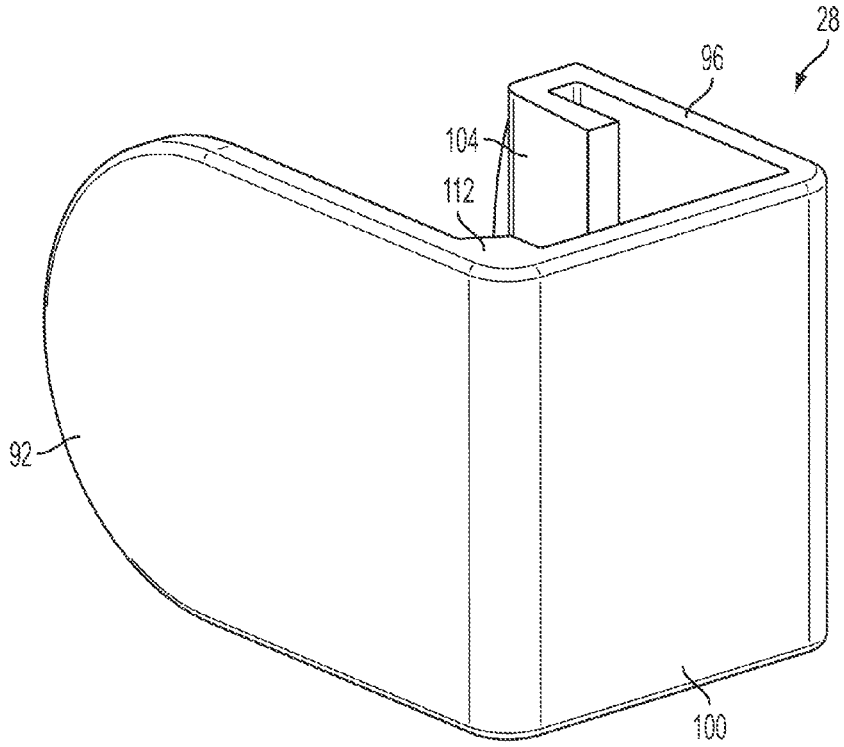
FIGS. 3A and 3B are perspective views of a mounting member of the display board assembly.
Figure 3B:
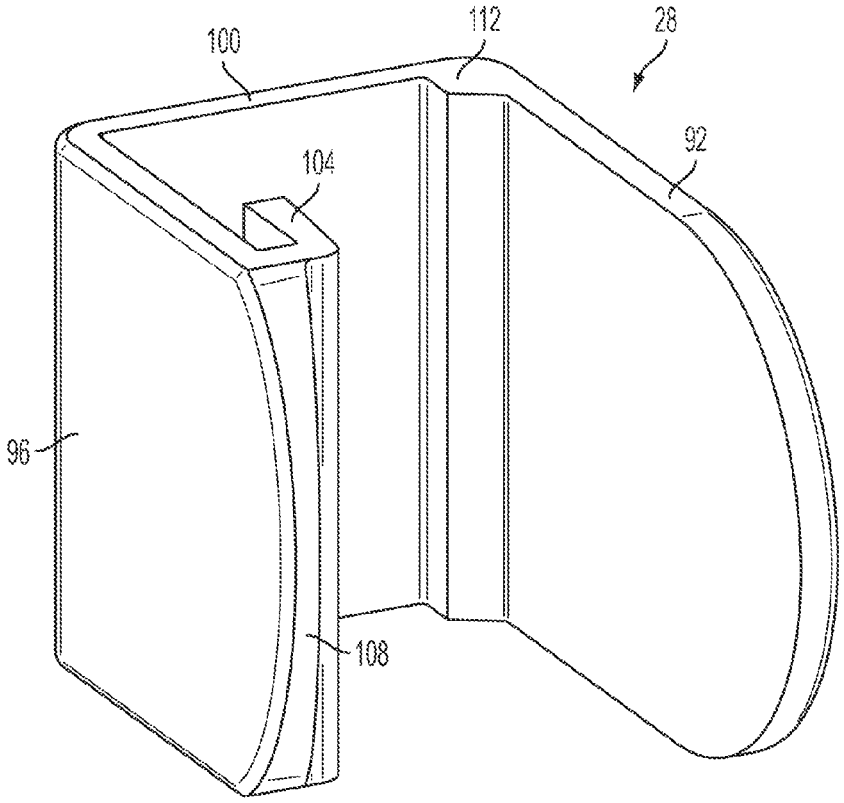

FIGS. 3A and 3B illustrate one of the mounting members 28, or clips, in more detail. The illustrated mounting member 28 is generally U-shaped and includes a first leg portion 92, a second leg portion 96 extending parallel to the first leg portion 92, and a bridge portion 100 connecting the first and second leg portions 92, 96. The first leg portion 92 is a rounded tab that fits within each of the slots 88 formed in the side edges 80, 84 of the display board 24. The second leg portion 96 extends over portions of the planar surface 64 and the frame 68 when the first leg portion 92 is received in one of the slots 88. The second leg portion 96 also includes a rib 104 that extends from a distal end 108 of the second leg portion 96 toward the first leg portion 92. The bridge portion 100 extends over a portion of the frame 68 when the first leg portion 92 is received in one of the slots 88. A protrusion 112 is formed at the intersection of the first leg portion 92 and the bridge portion 100 and extends inwardly toward the distal end 108 of the second leg portion 96. In the illustrated embodiment, the first leg portion 92, the second leg portion 96, and the bridge portion 100 are integrally formed as a single piece such that the mounting member 28 is a unitary member. In other embodiments, the first leg portion 92, the second leg portion 96, and the bridge portion 100 may be formed as separate pieces that are permanently or temporarily coupled together.

Figure 4:
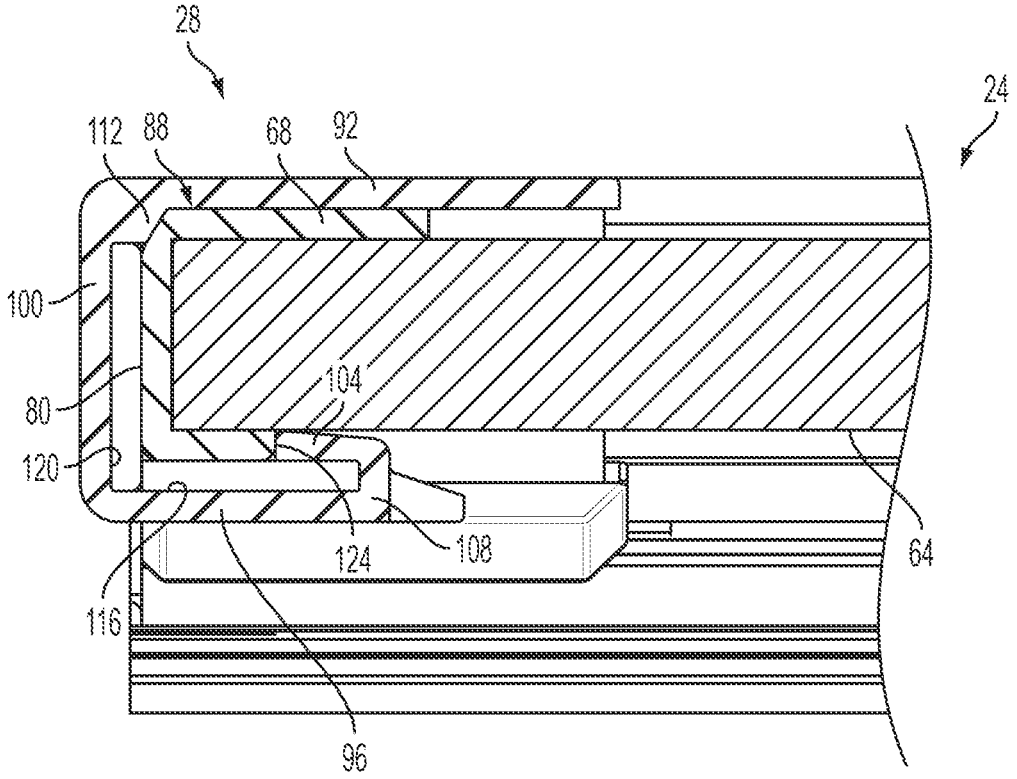
FIG. 4 is a cross-sectional view of a portion of the display board assembly taken through section line 4-4 of FIG. 2.

As shown in FIG. 4, the mounting member 28 is connected to the display board 24 by inserting the first leg portion 92 into one of the slots 88 in the first side edge 80. In this position, the mounting member 28 surrounds a portion of the frame 68 and engages the planar surface 64 to form a mounting location for the display board accessories 40, 44 (FIG. 1). When connected to the display board 24, the mounting member 28 defines a first gap 116 adjacent the planar surface 64 and a second gap 120 adjacent the side edge 80 of the board 24. The rib 104 extending from second leg portion 96 engages the planar surface 64 to space the second leg portion 96 apart from the planar surface 64 such that the first gap 116 is defined in front of the display board 24 (e.g., between the mounting member 28 and the planar surface 64). The rib 104 also engages a lip 124 formed between the frame 68 and the planar surface 64 to inhibit the mounting member 28 from freely sliding out of the slot 88 away from the display board 24. The protrusion 112 engages the side edge 80 to space the bridge portion 100 apart from the edge 80 such that the second gap 120 is defined to the side of the display board 24 (e.g., between the mounting member 28 and the side edge 80). The gaps 116, 120 are configured to receive corresponding portions of the display board accessories 40, 44 to removably couple the accessories 40, 44 to the mounting member 28.

To connect the mounting member 28 to the display board 24, the mounting member 28 is first aligned with the desired slot 88 in either the first side edge 80 or the second side edge 84. The mounting member 28 is then slid into the slot 88 by inserting the first leg portion 92 into the slot 88. As the mounting member 28 is slid into the slot 88, the second leg portion 96 flexes outwardly (i.e., away from the first leg portion 92) so that the rib 104 clears the frame 68. Once clear, the second leg portion 96 snaps back toward the first leg portion 92 and against the planar surface 64. In this position, the rib 104 on the second leg portion 96 engages the lip 124 formed between the frame 68 and the planar surface 64. The rib 104 thereby snap-fits over the lip 124 to secure the mounting member 28 to the display board 24.

To remove the mounting member 28 from the display board 24, the second leg portion 96 is flexed (e.g. pulled) away from the planar surface 64 to lift the rib 104 over the lip 124 formed between the frame 68 and the planar surface 64. When sufficiently flexed to clear the lip 124, the mounting member 28 can be slid away from the display board 24 and out of the slot 88. If desired, the mounting member 28 can then be inserted into a different slot 88 to secure the mounting member 28 at a different location on the display board 24.

Referring back to FIG. 1, two display board accessories 40, 44 are connected to the display board 24 using the mounting members 28. The mounting members 28 are universal mounts that alternately connect the different display board accessories 40, 44 to the display board 24. Each mounting member 28 may independently support either of the accessories 40, 44 when the other accessory 40, 44 is not coupled to the mounting member 28. In the illustrated embodiment, the first display board accessory 40 is a storage bin and the second display board accessory 44 is a marker caddy. In other embodiments, other suitable display board accessories (e.g., erasers, markers, cups, trays, etc.) may also or alternatively be connected to the display board 24 using the mounting members 28.

Figure 5:
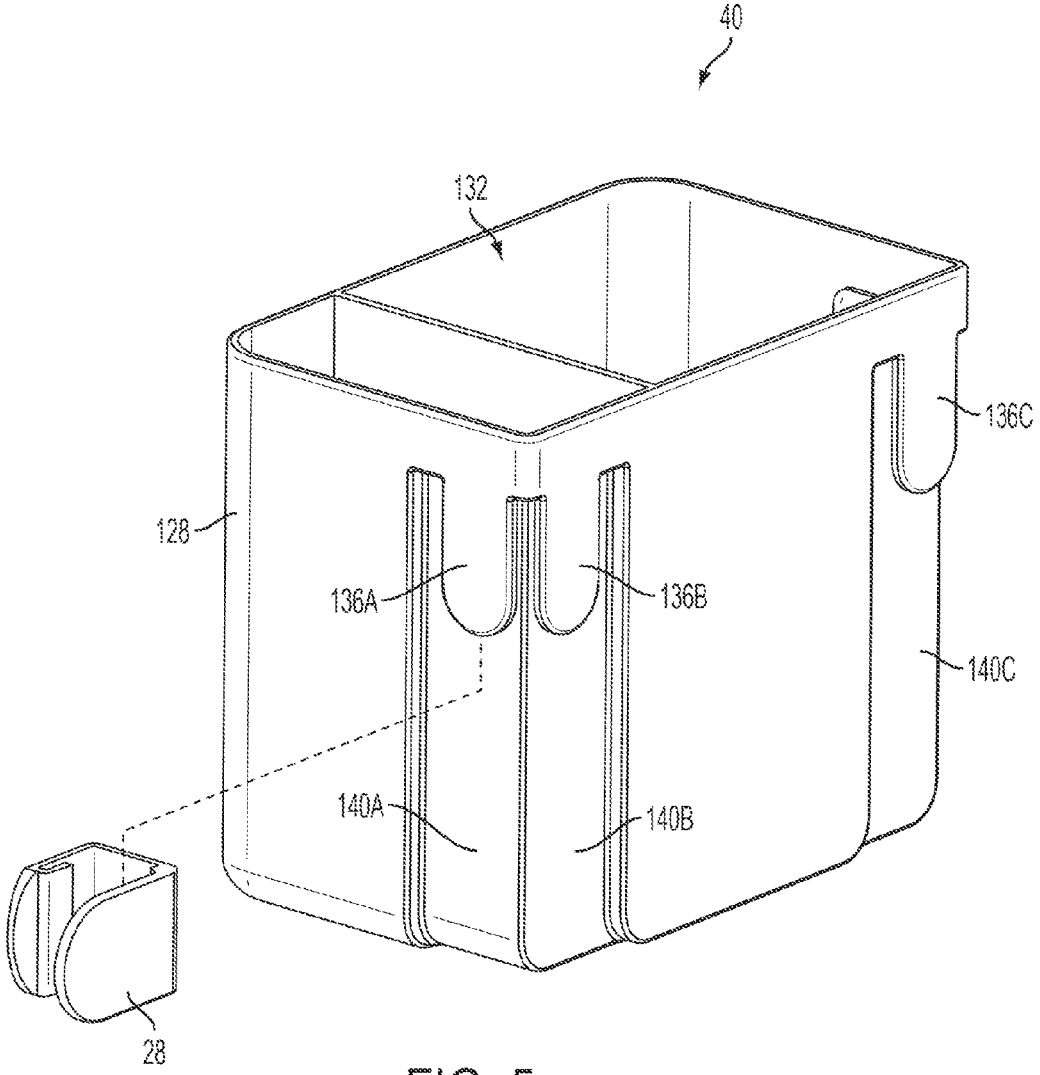
FIG. 5 is a perspective view of a storage bin for use with the display board assembly.

FIG. 5 illustrates the storage bin 40 in more detail. The storage bin 40 includes a sidewall 128 that defines a storage area 132. The illustrated storage bin 40 also includes four projections 136A-D, or tabs, formed in the sidewall 128 (the fourth projection 136D is shown in FIG. 6C). The projections 136A-D extend downwardly from an upper portion of the storage bin 40 generally parallel to the sidewall 128. The projections 136A-D are also located within recessed areas 140A-D of the sidewall 128 such that the projections 136A-D do not extend outwardly past the sidewall 128. In the illustrated embodiment, the first and second projections 136A-B are formed adjacent one corner of the storage bin 40, and the third and fourth projections 136C-D are formed adjacent another corner of the storage bin 40. In other embodiments, the projections 136A-D may be positioned elsewhere on the storage bin 40.

The projections 136A-D of the storage bin 40 are shaped and sized to fit within the gaps 116, 120 (FIG. 4) formed between the mounting member 28 and the display board 24. When one of the projections 136A-D is received in one of the gaps 116, 120, the storage bin 40 is removably coupled to the mounting member 28 and supported on the display board 24. By providing two gaps 116, 120 and four projections 136A-D, the storage bin 40 can be connected to the display board 24 in a variety of different positions, as shown in FIGS. 6A-6F.

Figure 6A:
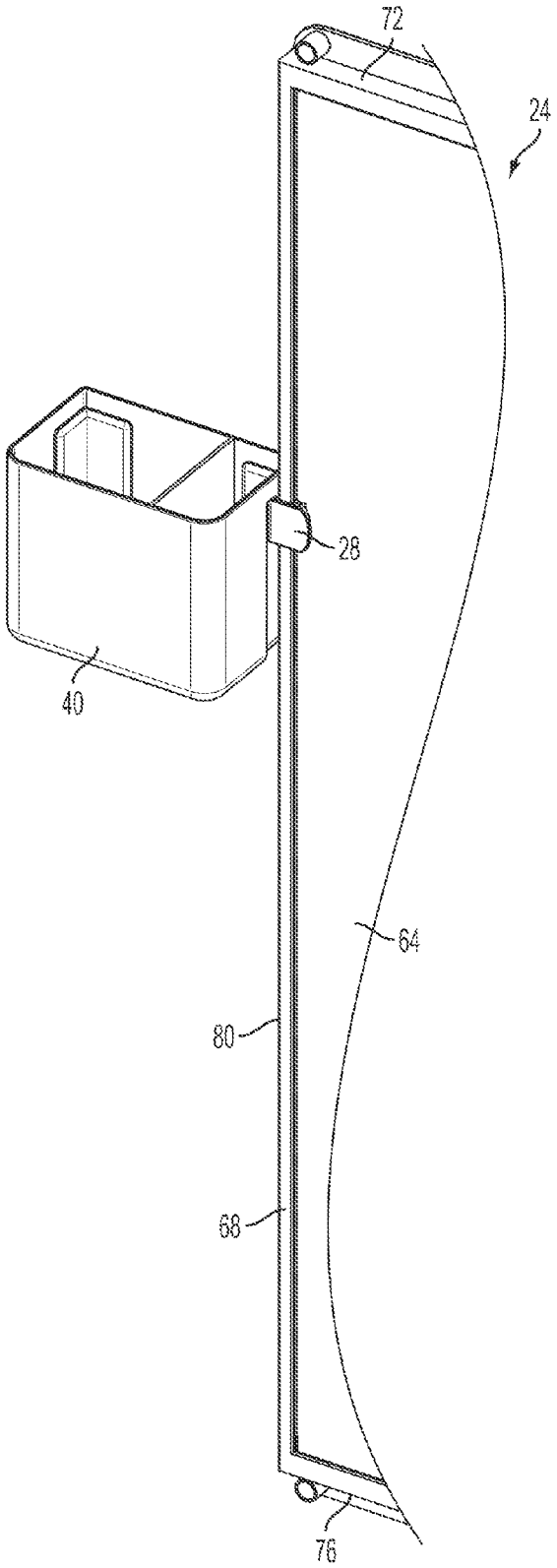
FIG. 6A is a perspective view of the storage bin coupled to the display board assembly in a first position.
Figure 6B:
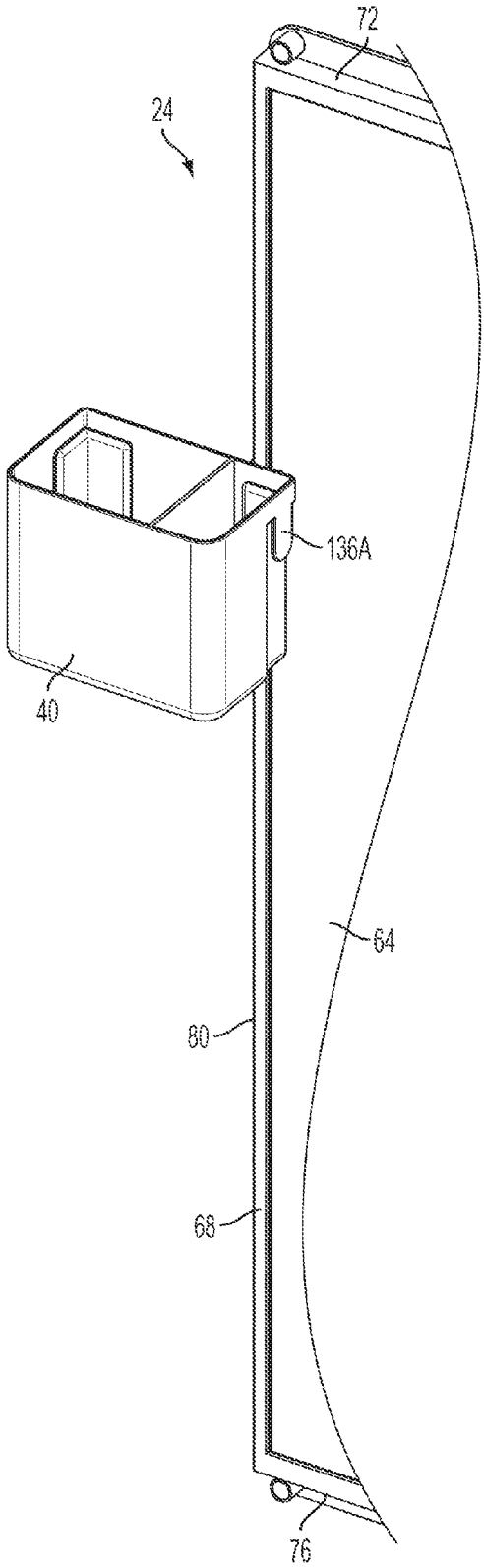
FIG. 6B is a perspective view of the storage bin coupled to the display board assembly in a second position.
Figure 6C:
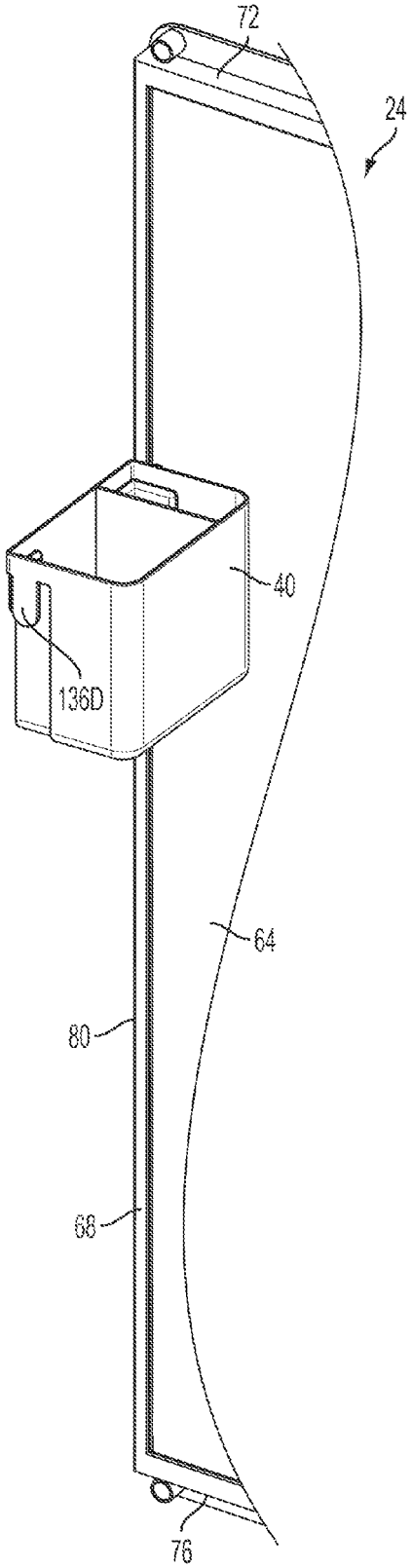
FIG. 6C is a perspective view of the storage bin coupled to the display board assembly in a third position.
Figure 6D:
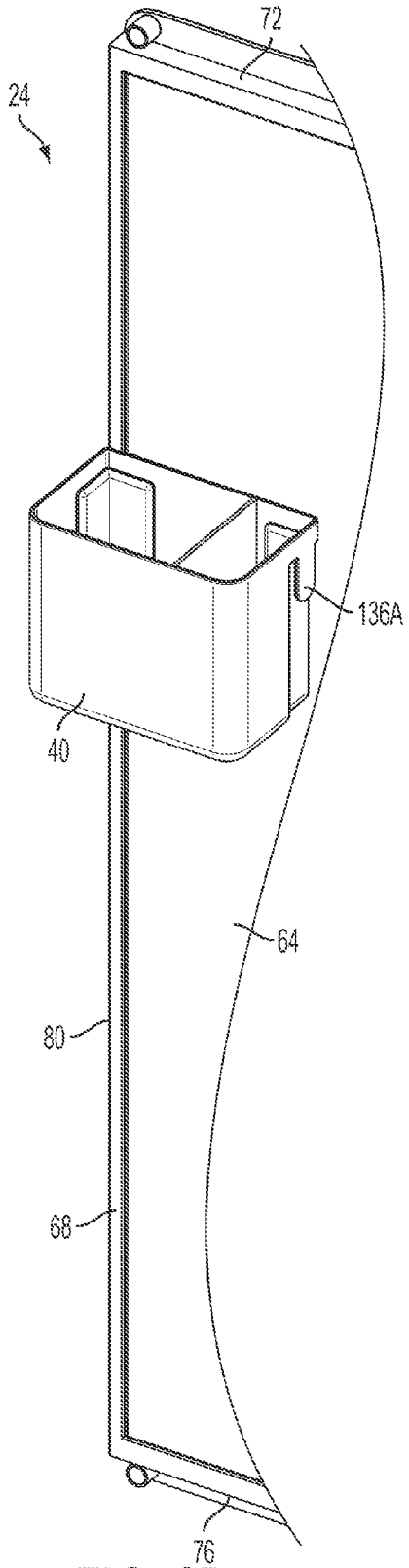
FIG. 6D is a perspective view of the storage bin coupled to the display board assembly in a fourth position.
Figure 6E:
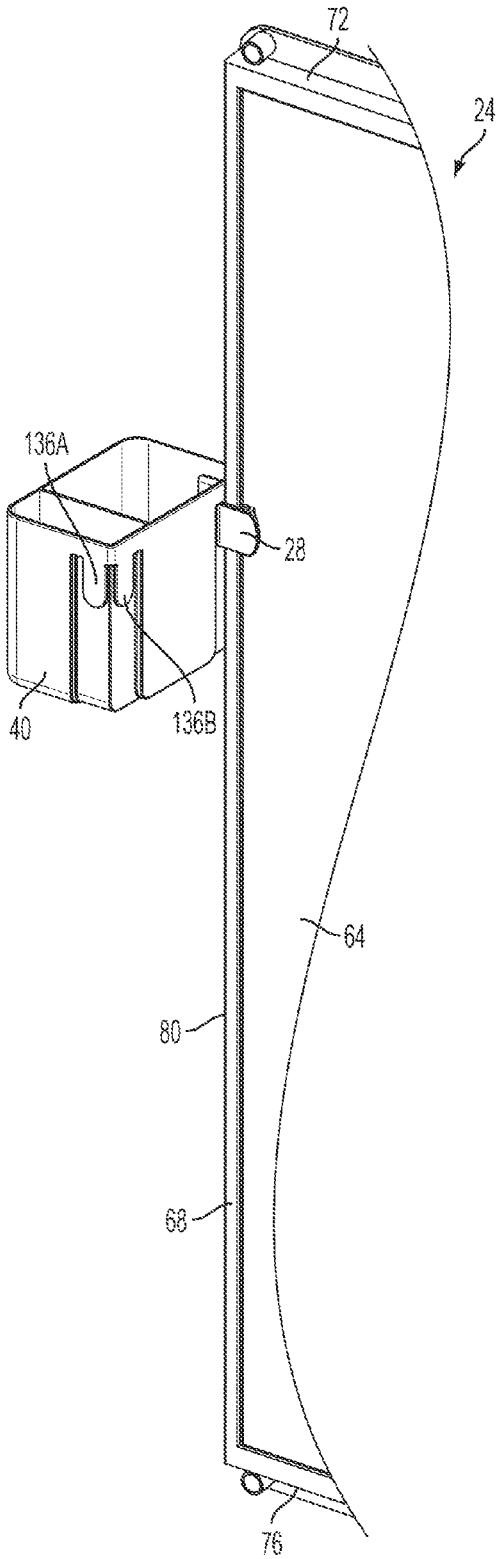
FIG. 6E is a perspective view of the storage bin coupled to the display board assembly in a fifth position.
Figure 6F:
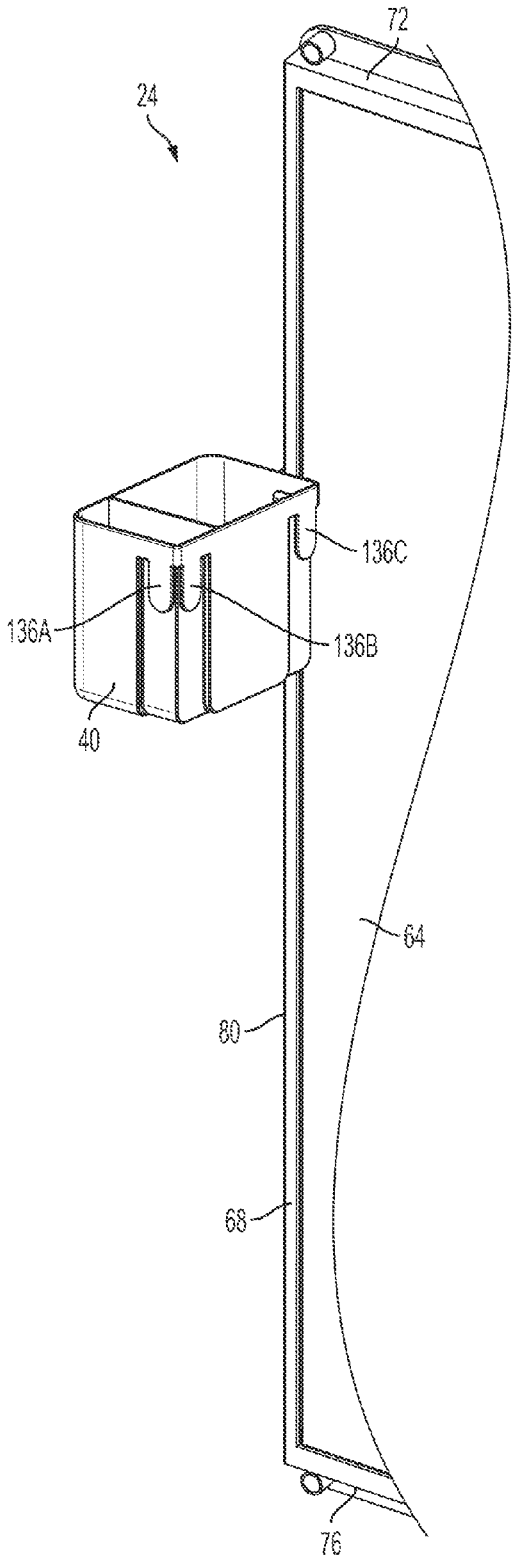
FIG. 6F is a perspective view of the storage bin coupled to the display board assembly in a sixth position.

In FIG. 6A, the first projection 136A of the storage bin 40 is received in the second gap 120 of the mounting member 28. In this position, the storage bin 40 is positioned entirely to the side of the display board 24. In FIG. 6B, the second projection 136B of the storage bin 40 is received in the first gap 116 of the mounting member 28. In this position, the storage bin 40 is positioned in front of the display board 24, and a relatively small portion of the storage bin 40 overlaps the planar surface 64. In FIG. 6C, the first projection 136A of the storage bin 40 is received in the first gap 116 of the mounting member 28. In this position, the storage bin 40 is positioned in front of the display board 24 and overlaps the planar surface 64. In FIG. 6D, the third projection 136C of the storage bin 40 is received in the first gap 116 of the mounting member 28. In this position, the storage bin 40 is positioned in front of the display board 24 and overlaps the planar surface 64. In FIG. 6E, the third projection 136C of the storage bin 40 is received in the second gap 120 of the mounting member 28. In this position, the storage bin 40 is positioned entirely to the side of the display board 24. In FIG. 6F, the fourth projection 136D of the storage bin 40 is received in the first gap 116 of the mounting member 28. In this position, the storage bin 40 is positioned in front of the display board 24, and a relatively small portion of the storage bin 40 overlaps the planar surface 64.

Figure 7:
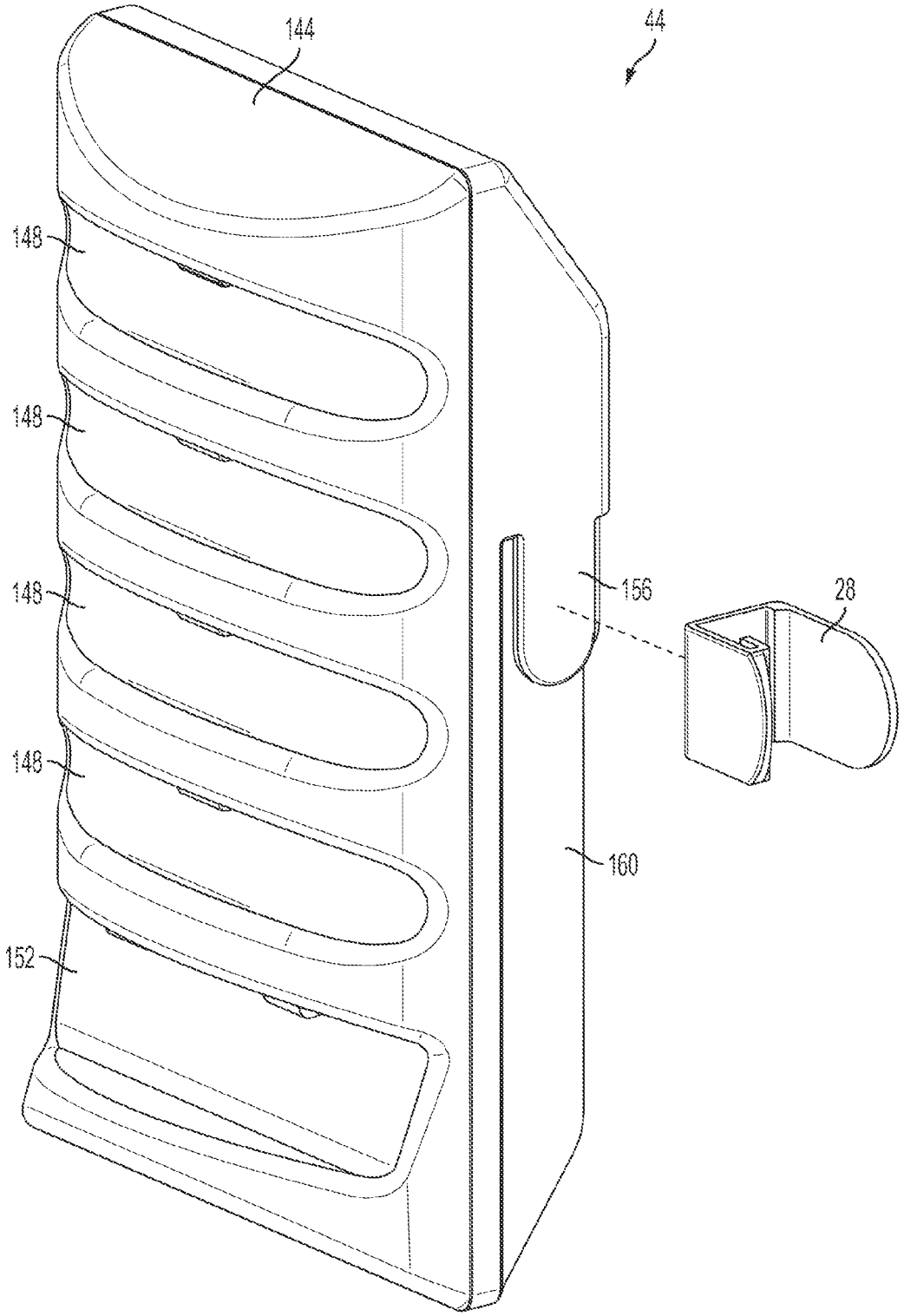
FIG. 7 is a perspective view of a marker caddy for use with the display board assembly.

FIG. 7 illustrates the marker caddy 44 in more detail. The illustrated marker caddy 44 includes a body 144 having four smaller slots 148 for receiving markers and one larger slot 152 for receiving an eraser. In other embodiments, the marker caddy 44 may have other configurations for holding markers and/or erasers. The illustrated marker caddy 44 also includes a projection 156, or tab, formed on one side of the body 144. Similar to the projections 136A-D of the storage bin 40 (FIG. 5), the projection 156 is shaped and sized to fit within the gaps 116, 120 (FIG. 4) formed between the mounting member 28 and the display board 24. In addition, the projection 156 is located in a recessed area 160 of the body 144 such that the projection 156 does not extend outwardly past the body 144. Although the marker caddy 44 is shown with only one projection 156, the marker caddy 44 may include additional projections formed on the opposite side of the body 144 or on the rear of the body 144 such that, like the storage bin 40, the marker caddy 44 can be connected to the display board 24 in a variety of different positions.

Figure 8:
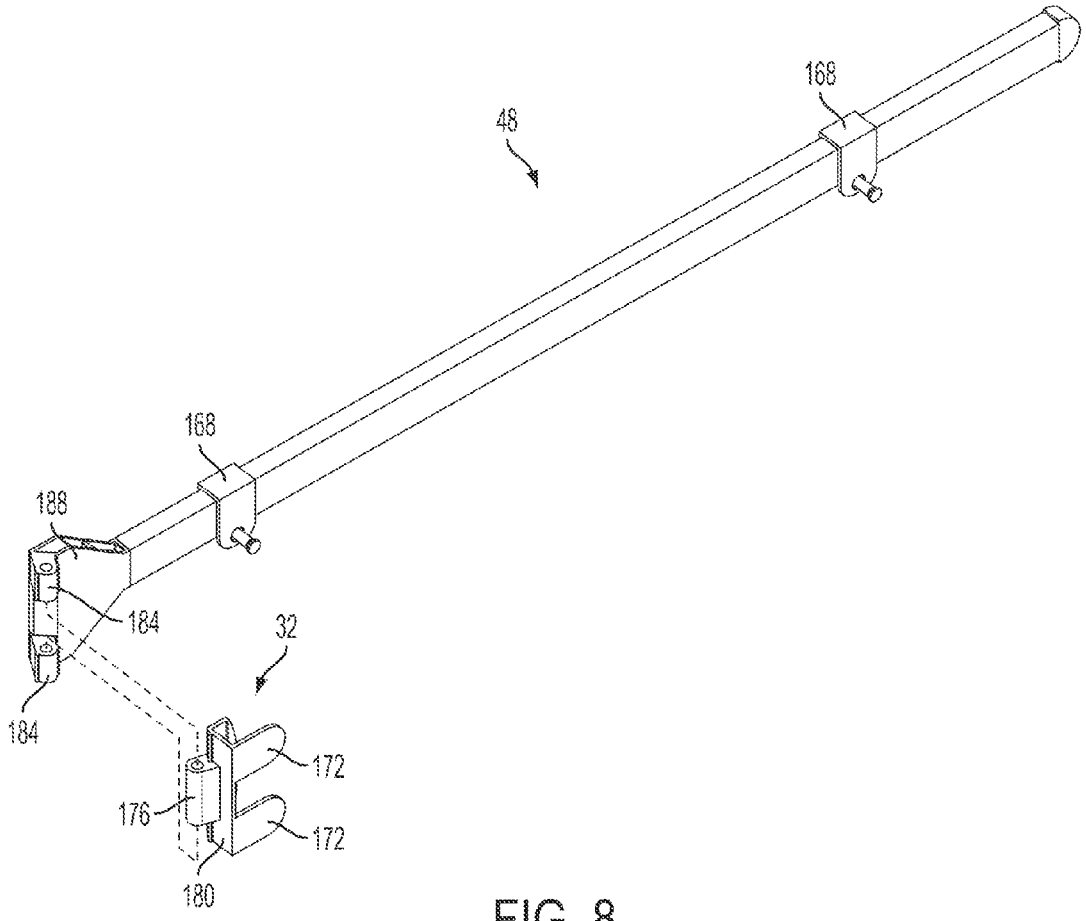
FIG. 8 is a perspective view of an easel arm for use with the display board assembly.
Figure 9:
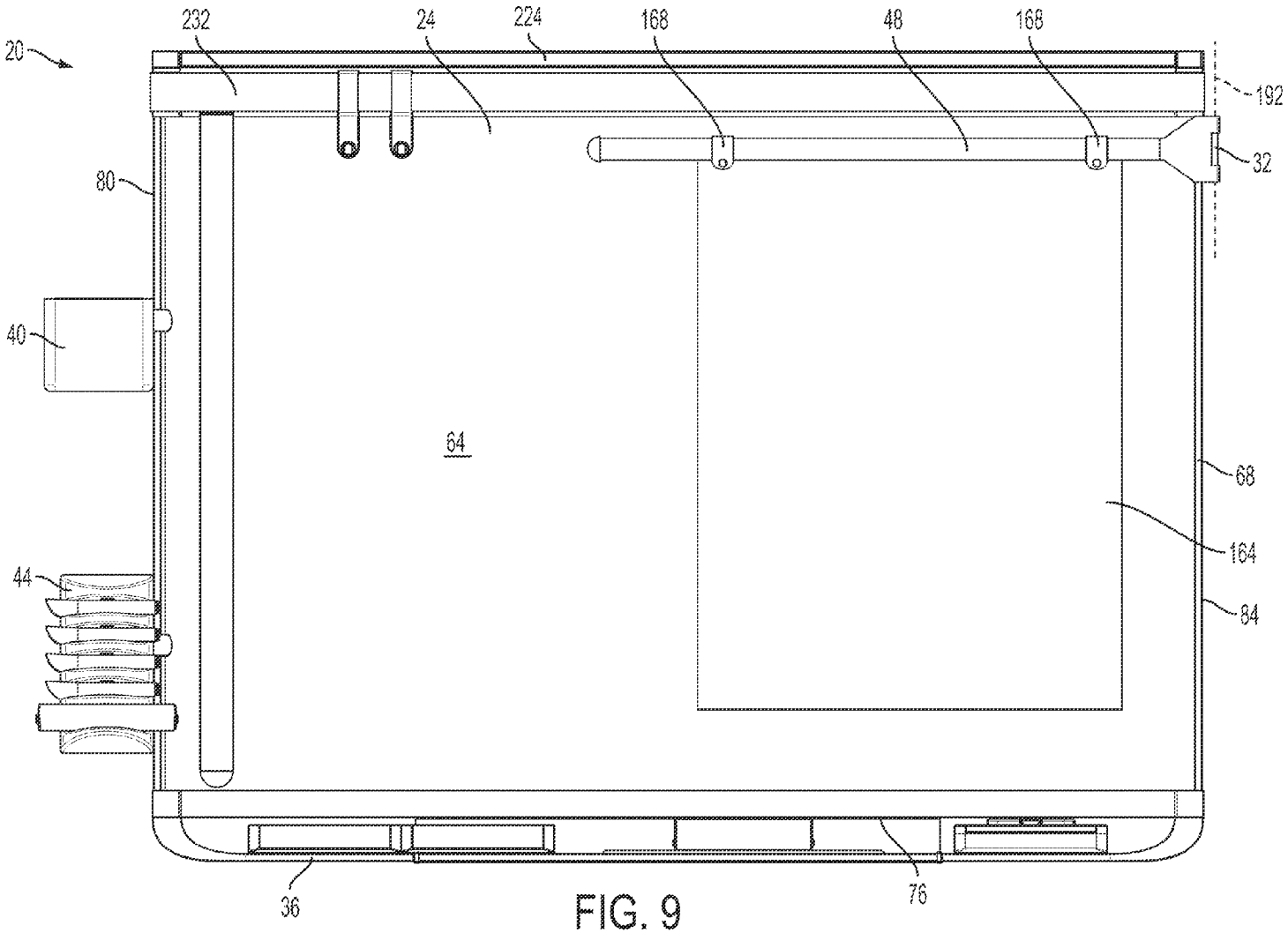
FIG. 9 is a front view of the display board assembly with the easel arm in a first position.
Figure 10:
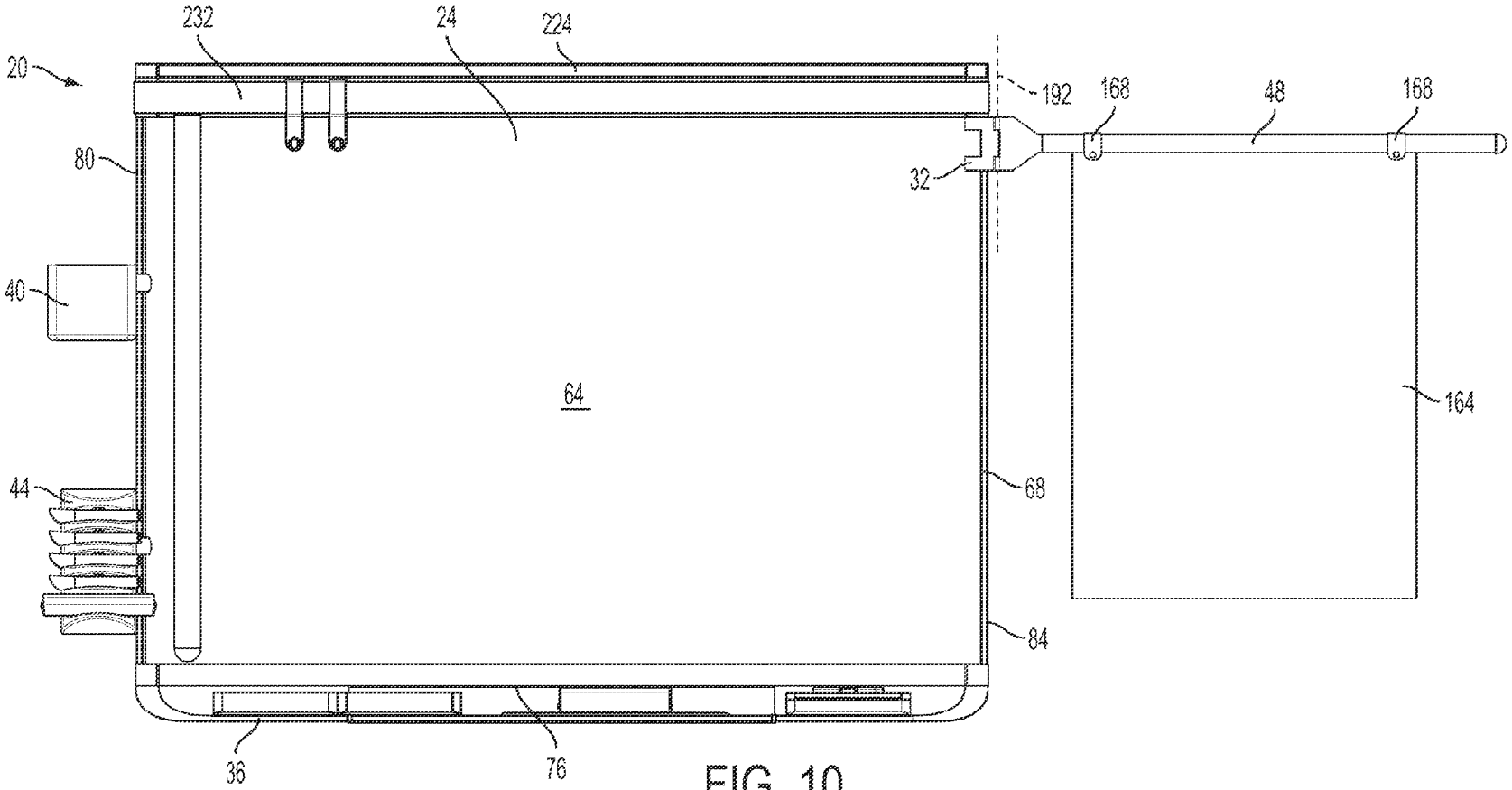
FIG. 10 is a front view of the display board assembly with the easel arm in a second position.

FIG. 8 illustrates another display board accessory 48 that can be connected to the display board 24. The illustrated accessory 48 is an easel arm that is configured to support an easel pad 164 (FIGS. 9 and 10). The easel arm 48 includes two brackets 168 that engage the easel pad 164 to suspend the pad 164 from the arm 48. The brackets 168 are movable (e.g., slidable) along the arm 48 to adjust the position of the easel pad 164 relative to the arm 48 and to adjust the relative distance between the brackets 168 for supporting different sizes of easel pads.

In the illustrated embodiment, the easel arm 48 is connected to the display board 24 with the mounting member 32. The mounting member 32 for the easel arm 48 is essentially two of the mounting members 28 (FIGS. 3A and 3B) formed together as a single mounting member. The illustrated mounting member 32 includes two first leg portions 172 that are received in adjacent slots 88 in either of the side edges 80, 84 of the display board 24, but is otherwise similar to the mounting member 28 described above. The mounting member 32 includes the two first leg portions 172 to compensate for the additional weight of the easel arm 48 and the easel pad 164 (compared to the relatively light storage bin 40 (FIG. 5) or marker caddy 44 (FIG. 7)). In other embodiments, the mounting member 32 may include three or more first leg portions 172, or the leg portions 172 may be spaced apart to fit within non-adjacent slots 88. In still other embodiments, the easel arm 48 may be connected to the display board 24 using one or more of the mounting members 28 described above.

The illustrated mounting member 32 also includes a hinge portion 176 extending from a bridge portion 180 of the mounting member 32. The hinge portion 176 pivotally couples the easel arm 48 to the mounting member 32. The hinge portion 176 fits between two spaced apart bosses 184 formed on an end 188 of the easel arm 48. A pin (not shown) extends through the bosses 184 of the easel arm 48 and the hinge portion 176 of the mounting member 32 to pivotally couple the easel arm 48 and the mounting member 32 together.

As shown in FIGS. 9 and 10, the easel arm 48 is movable (e.g., pivotable) relative to the display board 24 when the mounting member 32 is connected to the display board 24. The easel arm 48 pivots about an axis 192 that is parallel to the side edges 80, 84 of the board 24. In the illustrated embodiment, the easel arm 48 is pivotable at least 180 degrees relative to the display board 24 between a first position (FIG. 9) and a second position (FIG. 10). In the first position, the easel arm 48 extends across the display board 24 in a direction generally parallel to the planar surface 64 such that the easel pad 164 covers a portion of the planar surface 64. In the second position, the easel arm 48 extends away from the display board 24 in a direction generally parallel to the planar surface 64 such that the easel pad 164 is positioned to a side of the planar surface 64. It should be readily apparent that the easel arm 48 may also be moved to any intermediate positioned between the illustrated first and second positions. In some embodiments, the range of pivoting motion of the easel arm 48 may be limited to less than 180 degrees.

Referring back to FIG. 1, the tray 36 is mounted to the lower edge 76 of the display board 24. The tray 36 is positioned generally beneath the display board 24 and extends parallel to the lower edge 76 between the side edges 80, 84. The illustrated tray 36 supports some of the display board accessories 52, 56, 60 for use with the display board 24. For example, the tray can support two open-top containers 52, an eraser assembly 56, and a lidded container 60. The tray 36 may also be used to support other types of display board accessories for different applications.

Figure 11:
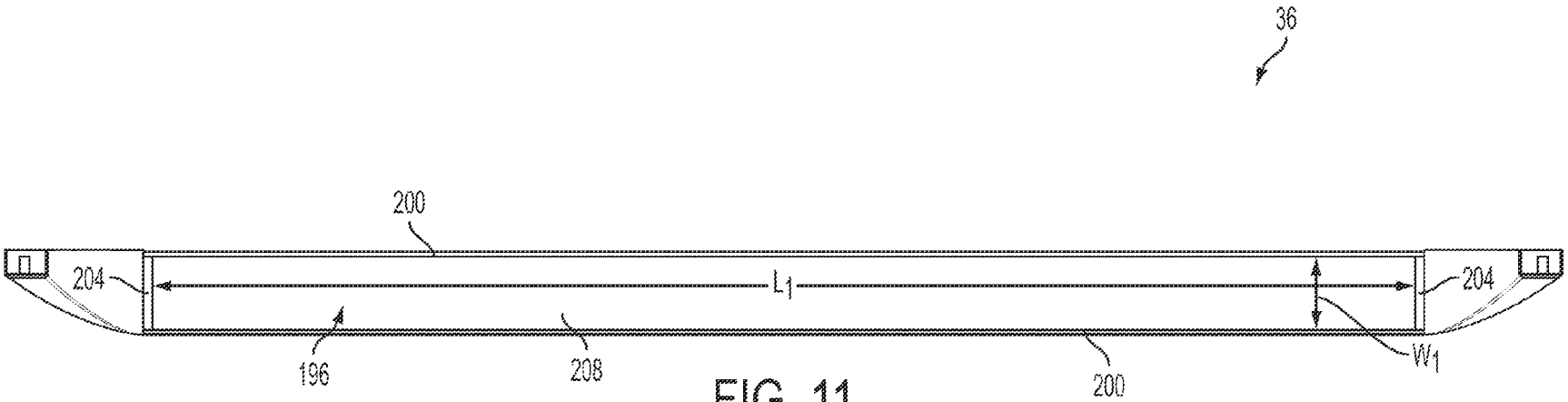
FIG. 11 is a top view of a tray of the display board assembly.

As shown in FIG. 11, the tray 36 defines a recess 196 that receives portions of the display board accessories 52, 56, 60. The recess 196 is defined by two sidewalls 200, two end walls 204, and an upwardly-facing surface 208 of the tray 36. The recess 196 has a length $L_1$ measured generally parallel to the lower edge 76 of the display board 24 between the end walls 204. The recess 196 also has a width $W_1$ measured generally perpendicular to the lower edge 76 between the sidewalls 200. The length $L_1$ is significantly larger than the width $W_1$ such that the recess 196 is elongated and rectangular.

Figure 12:
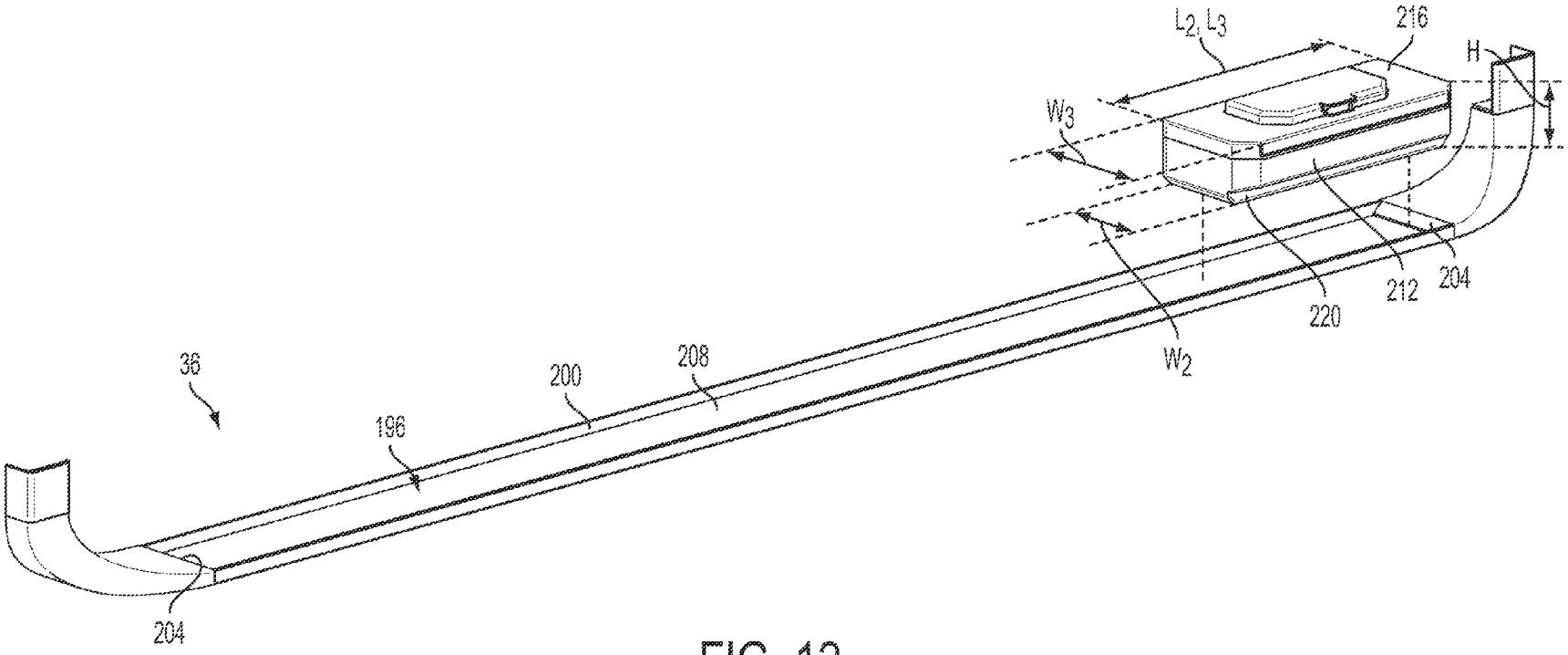
FIG. 12 is a perspective view of the tray with a container spaced apart from the tray.

FIG. 12 illustrates the lidded container 60 in relation to the tray 36. The lidded container 60 includes a main body 212 and a lid 216 hingedly coupled to the main body 212. The main body 212 defines a storage space for storing various items (e.g., wipes). The lidded container 60 also includes a flange 220 or undercut portion extending from the main body 212. In the illustrated embodiment, the flange 220 extends from a bottom of the main body 212 opposite the lid 216. The flange 220 is shaped and sized to fit within the recess 196 in the tray 36. In particular, the flange 220 has a length $L_2$ and a width $W_2$. The width $W_2$ of the flange 220 is less than a width $W_3$ of the main body 212, but is generally equal to the width $W_1$ of the recess 196. When positioned in the recess 196 of the tray 36, the flange 220 engages the sidewalls 200 to inhibit movement of the container 60 within the recess 196 in a direction generally parallel to the width $W_1$ of the recess 196 (i.e., in a direction perpendicular to the lower edge 76 of the display board 24). The length $L_2$ of the flange 220 is generally equal to a length $L_3$ of the main body 212, but is less than the length $L_1$ of the recess 196. As such, the container 60 is movable (e.g., slidable) along the length $L_1$ of the recess 196 (i.e., in a direction parallel to the lower edge 76 of the display board 24) without removing the container 60 from the recess 196.

Although not shown in detail, the open-top containers 52 of FIG. 1 may include similarly shaped and sized flanges or undercut portions as the flange 220 of the lidded container 60. When positioned in the recess 196 of the tray 36, the open-top containers 52 are likewise inhibited from moving in the direction generally parallel to the width $W_1$ of the recess 196, but are slidable along the length $L_1$ of the recess 196, similar to the lidded container 60.

As shown in FIG. 1, the upwardly-facing surface 208 of the tray 36 is spaced a vertical distance D from the lower edge 76 of the display board 24. The lidded container 60 has a height H (FIG. 12) measured from a bottom surface of the flange 220 to an upper surface of the lid 216. The height H of the container 60 is similar to, but slightly less than the vertical distance D between the tray 36 and the display board 24. Due to the similarly between the vertical distance D and the height H, the lidded container 60 is releasably captured between the upwardly-facing surface 208 of the tray 36 and the lower edge 76 of the display board 24 when positioned in the recess 196 of the tray 36. That is, the container 60 cannot be lifted straight up and off of the tray 36. Instead, the container 60 is tilted relative to the tray 36 to clear the front sidewall 200 and then pulled forwardly and upwardly away from the tray 36. Such an arrangement inhibits the container 60 (and other display board accessories) from being accidentally knocked off of or otherwise removed from the tray 36 (e.g., such as when a wipe is being pulled out of the container 60).

Referring back to FIG. 1, the display board assembly 20 includes a tack strip 224 connected to the display board 24. The tack strip 224 is mounted to the side edges 80, 84 of the display board 24 and spaced apart from the upper edge 72 (FIGS. 6A-6F). The illustrated tack strip 224 extends parallel to the upper edge 72 between the side edges 80, 84 of the display board 24. The tack strip 224 includes a block of cork 228, or other suitable material, to receive thumbtacks and pushpins.

The display board assembly 20 also includes an eraser bar assembly 232 connected to the display board 24. The illustrated eraser bar assembly 232 includes a track 236 and an eraser bar 240. The track 236 is mounted to the upper edge 72 of the display board 24 beneath the tack strip 224. The track 236 extends parallel to the upper edge 72 between the side edges 80, 84 of the board 24. The eraser bar 240 is coupled to the track 236 and extends downwardly from the track 236 in a direction generally perpendicular to the upper edge 72. A pad of eraser material (not shown) is coupled to a side of the eraser bar 240 that faces the planar surface 64 of the display board 24.

In operation, the eraser bar 240 is movable along the track 236 between the first side edge 80 of the display board 24 and the second side edge 84 of the board 24. As the eraser bar 240 moves across the board 24, the pad of eraser material wipes the planar surface 64 to clean the board 24. In the illustrated embodiment, the eraser bar 240 is movable by manually sliding the eraser bar 240 along the track 236. In other embodiments, the eraser bar 240 may be electrically driven along the track 236 by a motor or other suitable device.

Figure 13:
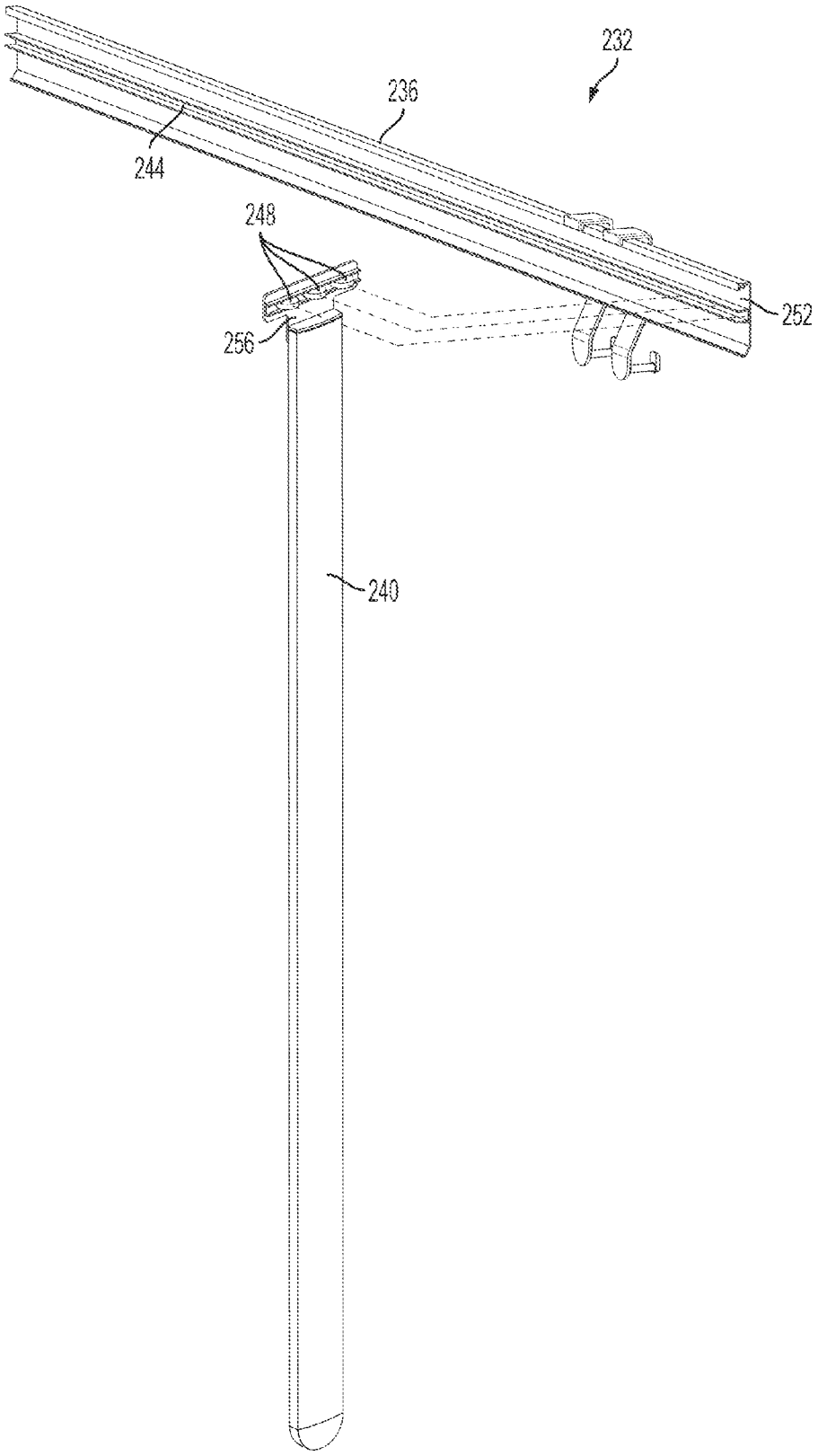
FIG. 13 is an exploded perspective view of an eraser bar assembly for use with the display board assembly.

As shown in FIG. 13, the track 236 includes a channel 244 and the eraser bar 240 includes a plurality of rollers 248. The channel 244 is formed on an inner surface 252 of the track 236 and is generally covered when the track 236 is mounted to the display board 24. The rollers 248 are coupled to an end 256 of the eraser bar 240 and received within the channel 244 to hang or suspend the bar 240 from the track 236. The rollers 248 roll and/or slide within the channel 244 to facilitate moving the eraser bar 240 along the track 236. In other embodiments, other suitable connecting members (e.g., low-friction blocks) may be used to movably connect the eraser bar 240 to the track 236.

In some embodiments, the eraser bar 240 may also include clips or mounts that receive and hold markers. The clips can orient the markers such that the markers face and engage the planar surface 64 of the display board 24. In such embodiments, moving the eraser bar 240 along the track 236 draws horizontal, straight lines (e.g., a portion of a grid) on the display board 24 with the markers.

Although the invention has been described with reference to certain preferred embodiments, variations and modifications exist within the scope and spirit of one or more independent aspects of the invention.

Various features and advantages of the invention are set forth in the following claims.

What is claimed is:

1. A display board assembly comprising:

a display board including a planar surface and an edge extending along at least a portion of the planar surface;

a mounting member coupled to the display board, the mounting member forming a first gap between the mounting member and the planar surface of the display board and a second gap between the mounting member and the edge of the display board, the first and second gaps being perpendicular to each other; and a display board accessory including a projection, the display board accessory being removably coupled to the mounting member in one of a first position, in which the projection is received in the first gap, and a second position, in which the projection is received in the second gap.

2. The display board assembly of claim 1, wherein the display board accessory overlaps a portion of the planar surface when in the first position, and wherein the display board accessory is positioned to a side of the planar surface when in the second position.

3. The display board assembly of claim 1, wherein the mounting member includes a first portion that extends over a portion of the planar surface of the display board and a second portion that extends over a portion of the edge of the display board.

4. The display board assembly of claim 3, wherein the first portion of the mounting member is spaced apart from the planar surface of the display board to define the first gap between the mounting member and the planar surface.

5. The display board assembly of claim 3, wherein the second portion of the mounting member is spaced apart from the edge of the display board to define the second gap between the mounting member and the edge.

6. The display board assembly of claim 1, wherein the display board accessory includes a second projection, and wherein the display board accessory is alternatively coupled to the mounting member in a third position, in which the second projection is received in the first gap.

7. The display board assembly of claim 1, wherein the display board accessory is a first display board accessory, and further comprising a second display board accessory that is different from the first display board accessory, wherein the second display board accessory includes a projection, and wherein the second display board accessory is removably coupled to the mounting member in one of a first position, in which the projection is received in the first gap, and a second position, in which the projection is received in the second gap, when the first display board is accessory is not coupled to the mounting member.

8. The display board assembly of claim 1, wherein the display board further includes a series of discrete slots formed along the edge, and wherein the mounting member is received in one of the series of discrete slots.

9. The display board assembly of claim 8, wherein the mounting member is removable from the one of the series of discrete slots and receivable in another of the series of discrete slots.

10. The display board assembly of claim 1, wherein the display board accessory includes one of a storage bin and a marker caddy.

11. A display board assembly comprising:

a display board including a planar surface, an edge extending along at least a portion of the planar surface, and a series of discrete slots formed along the edge;

a mounting member including a leg portion received in one of the series of discrete slots, the leg portion being sized to substantially fill the one of the series of discrete slots, the mounting member forming a first gap between the mounting member and the planar surface of the display board and a second gap between the mounting member and the edge of the display board, the first and second gaps being perpendicular to each other; and a display board accessory coupled to the mounting member to mount the display board accessory on the display board.

12. The display board assembly of claim 11, wherein the display board accessory is removably coupled to the mounting member.

13. The display board assembly of claim 11, wherein the mounting member is generally U-shaped.

14. The display board assembly of claim 13, wherein the leg portion is a first leg portion, wherein the mounting member also includes a second leg portion extending parallel to the first leg portion and a bridge portion connecting the first and second leg portions, wherein the first leg portion fits within the one of the series of discrete slots, wherein the second leg portion extends over a portion of the planar surface, and wherein the bridge portion extends over a portion of the edge.

15. The display board assembly of claim 14, wherein the second leg portion includes a rib that snap-fits over a lip formed between the edge and the planar surface.

16. The display board assembly of claim 11, wherein the display board further includes a frame surrounding the planar surface, and wherein the frame forms the edge of the display board and defines the series of discrete slots.

17. The display board assembly of claim 11, wherein the mounting member is removable from the one of the series of discrete slots and receivable in another of the series of discrete slots.

18. The display board assembly of claim 11, wherein the edge extends along a side of the planar surface between an upper edge and a lower edge of the display board.

19. The display board assembly of claim 11, wherein the edge is a first edge, wherein the display board includes a second edge that is spaced apart from the first edge and extends along another portion of the planar surface, and wherein the display board further includes a second series of discrete slots formed along the second edge.

20. The display board assembly of claim 11, wherein the display board accessory includes one of a storage bin, a marker caddy, and an easel arm.

21. The display board assembly of claim 11, wherein the mounting member is received in two of the series of discrete slots, and wherein the display board accessory is an easel arm.

22. A display board assembly comprising:

a display board including a planar surface, an edge extending along at least a portion of the planar surface, and a series of discrete slots formed along the edge;

a mounting member received in one of the series of discrete slots and extending over a portion of the planar surface and a portion of the edge, the mounting member forming a first gap between the mounting member and the planar surface of the display board and a second gap between the mounting member and the edge of the display board, the first and second gaps being perpendicular to each other;

a first display board accessory including a projection, the first display board accessory being removably couplable to the mounting member in one of a first position, in which the projection is received in the first gap, and a second position, in which the projection is received in the second gap; and a second display board accessory that is different from the first display board accessory, the second display board accessory including a projection, the second display board accessory being removably couplable to the mounting member in one of a first position, in which the projection is received in the first gap, and a second position, in which the projection is received in the second gap, when the first display board accessory is not coupled to the mounting member.

* * * * *